US006918418B1

(12) United States Patent
Farris

(10) Patent No.: US 6,918,418 B1
(45) Date of Patent: Jul. 19, 2005

(54) METHOD AND APPARATUS FOR THE STORAGE AND TRANSFER OF A LYOPHILISATE

(76) Inventor: Barry Farris, P.O. Box 1817, Zephyr Cove, NV (US) 89448

( * ) Notice: Subject to any disclaimer, the term of this patent is extended or adjusted under 35 U.S.C. 154(b) by 360 days.

(21) Appl. No.: 09/524,213

(22) Filed: Mar. 13, 2000

(51) Int. Cl.[7] ..... B65B 1/04

(52) U.S. Cl. ..... 141/319; 141/27; 141/329; 141/330

(58) Field of Search ..... 141/25–27, 114, 141/311 R, 319, 329, 330; 222/95, 107, 541.6, 222/541.9

(56) References Cited

U.S. PATENT DOCUMENTS

| | | | |
|---|---|---|---|
| 829,178 | A | 8/1906 | Stegmaier |
| 2,486,321 | A | 10/1949 | O'Sullivan |
| 3,187,966 | A | 6/1965 | Klygis |
| 3,419,007 | A | 12/1968 | Love |
| 3,977,553 | A | 8/1976 | Cornett, III et al. |
| 4,046,145 | A | 9/1977 | Choksi et al. |
| 4,130,117 | A | 12/1978 | Van Eck |
| 4,213,456 | A | 7/1980 | Bottger |
| 4,465,472 | A | 8/1984 | Urbaniak |
| 4,643,309 | A | 2/1987 | Evers |
| 4,883,473 | A | 11/1989 | Thomas |
| 4,944,736 | A | 7/1990 | Holtz |
| 5,035,689 | A | 7/1991 | Schroeder |
| 5,201,751 | A | 4/1993 | Cohen |
| 5,222,948 | A | 6/1993 | Austin et al. |
| 5,261,881 | A | 11/1993 | Riner |
| 5,334,173 | A | 8/1994 | Armstrong, Jr. |
| 5,374,263 | A | 12/1994 | Weiler |
| 5,409,125 | A | 4/1995 | Kimber et al. |
| 5,716,346 | A | 2/1998 | Farris |
| 6,126,646 | A | 10/2000 | Hansen et al. |
| 6,142,977 | A | 11/2000 | Kolberg et al. |

FOREIGN PATENT DOCUMENTS

| | | |
|---|---|---|
| EP | 0 324 257 A2 | 7/1989 |
| EP | 0 350 772 A1 | 1/1990 |
| FR | 259 4687 A | 2/1986 |

*Primary Examiner*—Timothy L. Maust
(74) *Attorney, Agent, or Firm*—Bernhard Kreten

(57) ABSTRACT

A method and an apparatus for the storage and transfer of a lyophilisate is disclosed. An ampule prior to its sealment has an orifice at one end for the addition of the lyophilisate. The ampule has a body portion formed with flexibly deformable walls and defines a blind bore. After placement of the lyophilisate, the orifice is closed.

15 Claims, 9 Drawing Sheets

METHOD AND APPARATUS FOR THE STORAGE AND TRANSFER OF A LYOPHILISATE

FIELD OF THE INVENTION

The following invention relates generally to a method and apparatus for storing a dry substance, activating the substance with liquid and subsequently transferring the substance from storage into a syringe or cannula without the need for a needle. More particularly, the invention relates to a storage container for storing a substance that has undergone a lyophilization process and is ready for the introduction of a liquid to dissolve the lyophilisate into a medium that may be then utilized according to its appropriate prescription. More specifically, the instant invention inhibits the lability of pharmaceuticals.

BACKGROUND OF THE INVENTION

The potency, efficacy, freshness and/or safety of many substances degrade over time. Therefore, manufacturers will usually mark their products with a date of expiration which states explicitly that the contents contained therein will not be as effective, fresh or safe to use subsequent to the date printed on the identification mark. This is of particular concern to pharmaceutical companies dealing with the efficacy of their pharmaceutical products degrading over time, because of many pharmaceuticals' labile nature. This degradation may reach a point where using the particular pharmaceutical product beyond the date imprinted on the bottle could result the pharmaceutical providing no effect, not enough effect or negative effects on persons taking the product as prescribed by the pharmaceutical manufacturer's directions, distributor's directions, seller's directions, product's directions, pharmacy's directions and/or the attending physician's directions.

SUMMARY OF THE INVENTION

The instant invention inhibits the labile nature of substances. In its essence, the instant invention takes advantage of the lyophilic process and provides a container for storing the lyophilisate which in such a state inhibits the lability of pharmaceutical products. This container provides an aseptic environment that prevents bacteria from propagating to the pharmaceutical product and thus potentially effecting the product in an adverse manner.

Further, the instant invention provides for a process that dissolves a powdery substance stored in an ampule. The ampule has a first coupler defining an outlet which has been sealed by occluding the first coupler outlet with a first cap.

A needleless syringe or cannula is configured with a second coupler and an opening which communicates within an interior cylindrical hollow of the syringe so that fluid passes by the second coupler through the opening and into the cylindrical hollow and fills the syringe or cannula. The steps include providing a vial which has been filled with a fluid. The vial has a vial outlet including a third coupler defining the vial outlet and which has been sealed by occluding the third coupler of the vial outlet with a second cap. Subsequently, remove the second cap from the vial and orient the second and third couplers of the syringe or cannula and vial, respectively into complemental, fluid-tight locking engagement so that the opening of the vial registers with the opening of the syringe or cannula. Next, transfer the contents of the vial to the syringe or cannula. This is described in U.S. Pat. No. 5,716,346. Subsequently, remove the first cap from the ampule and orient the first coupler of the ampule with the second coupler of the syringe or cannula into complemental, fluid-tight locking engagement so that the opening of the ampule registers with the opening of the syringe or cannula. Next, transfer the fluid of the syringe into the ampule; mix the powdery substance and fluid until the powdery substance is dissolved thus making a mixture preferably while the ampule and syringe or cannula remain mated. Then convey the mixture back into the syringe or cannula and prepare the syringe or cannula for the capability of inserting the mixture into a recipient object.

Further, the instant invention provide for another process for forming an ampule to transfer pharmaceutical grade fluid or solid to be administered. By "fluid" it is meant to include compressible fluid such as gas or liquid as well as pulverulent matter. Solid is defined as compressed or bound together pulverulent material or material embodied as a pill, lozenge, crumbly matter or discrete particles to be dissolved. The process includes: forming an ampule with resilient walls so that the ampule can be collapsed and creating an orifice to introduce the dry pharmaceutical grade fluid or solid; forming an opening on the ampule such that the opening is circumscribed by a coupler which is to be complementally fastened to receive a dose administering device; filling the ampule with the liquid, mixing the liquid with the dry and using.

Further, the instant invention provides for an ampule for storing a pharmaceutical product in a manner to inhibit lability of the product and permitting the transfer of the product in an aseptic manner to avoid nosocomial infection from ambient air. The ampule has resilient walls that can be collapsed and includes an orifice to pass a pharmaceutical grade fluid (as recited in the previous paragraph for example) or solid therethrough and an opening on said ampule whereby the opening is circumscribed by a coupler which is to be complementally fastened to receive a dose administering device.

Further, the instant invention completely avoids the use of a needle when loading the syringe by extracting fluid from a vial or an ampule. In its essence as such, the instant invention takes advantage of a coupling that is the standard on a majority of syringes which had heretofore only been used in the past to support the hypodermic needle on the syringe. This coupling, called a luer fitting, has a male component and a female component. Typically, the syringe is configured with the "male" luer coupling which appears as a truncated cone that has an opening at its narrowest cross-section some luer couplings are threaded. The luer coupling typically diverges toward an interior cylindrical hollow portion of the syringe. The instant invention replaces the "female" luer coupling and associated needle itself and instead replicates the female coupling on a specially formed ampule or vial so that docking between the ampule or vial and a needleless syringe benefits from the pre-existing male coupling already found on common syringes. Walls of the ampule or vial are flexible to not only promote removal of the fluid therewithin, but to avoid ambient air into the vial or ampule during fluid transfer. Instead of admitting air, the walls collapse.

Further the instant invention may include a filter cartridge having a body with first and second coupling-ends and a filter disposed within the body; whereby the first coupling-end includes a female luer-type tapering for frictional engagement with a needleless syringe or cannula; and whereby the second coupling-end includes a male luer-type tapering for frictional engagement with a female luer-type taper on a proximal end of a needle, cannula, catheter, etc. Further, the filter cartridge of instant invention can be integral with the ampule of the present invention.

Further the instant invention provides a filtered needle for use with the system of the present invention.

With an opening of the ampule and the opening of the syringe in face-to-face docking registry and in fluidic communication, the ampule can be evacuated by any of a combination of manipulative steps. First, assume the syringe is in its initialized state, with its plunger nested well within the cylindrical hollow of the syringe body so that the plunger is in a compact, retracted state. First the syringe is loaded with liquid, preferably from the vial. Next the syringe feeds the ampule with the vial's liquid for mixing. The contents of the ampule is then retransferred to the syringe (while still docked to the ampule) with none or a minimal, negligible amount of ambient air introduced into the syringe. Deforming the side walls of the ampule and "milking" (i.e. applying hydrostatic force to) the liquid from the ampule and thus into the syringe eliminates air invasion. This causes the plunger of the syringe to translate outside the cylindrical hollow. As the plunger advances out of the cylindrical hollow, liquid enters the syringe.

Another strategy involves manipulation of the plunger to draw the fluid from the ampule by suction so that the arming of the syringe occurs by retracting the plunger to extract the liquid from the ampule without introducing ambient air. As before, the plunger starts well within the syringe and reciprocates outwardly of the cylindrical hollow.

A third strategy is a hybrid of the two previously discussed techniques which involves manipulation of both the ampule by squeezing the ampule and suction by moving the plunger out of the syringe cylindrical hollow. Thereafter, in all cases the ampule is disconnected from the syringe.

Once the ampule has been removed, a syringe has the intended fluid medication disposed therewithin. Unlike the prior art, no needle has yet been involved. Also, no air from the ambient environment has been mixed with the sterile fluid as was the case with rigid wall vials.

In one form of the invention, it is contemplated that the opening associated with the ampule is provided with a removable cap having a luer-type coupling and an indicia bearing tab. The medicinal contents of the ampule is stamped on the tab for identification purposes. With such an arrangement, it is possible to transfer the cap and tab from the ampule and connect the cap to the syringe to provide a tell tale of the contents of the fluid contained within the syringe. As an alternative, the ampule could remain docked to the syringe until subsequent use. The ampule would also note the contents on a surface thereof.

As a result of this system, the entire process for filling a syringe has been accomplished without the use of a needle. Personnel are able to operate more quickly with less fear of either inadvertent needle stick or inadvertent exposure to the medicine contained within the syringe.

It is to be noted that for many in-patients, the standard procedure in a hospital is to tap into a person's vein only once with an infusion catheter and to leave the catheter needle in place with tubing communicating therewith so that subsequent fluids such as intravenous drips and the like can be used. With such a system, a needle would never be needed with the syringe according to the present invention. "Y" connectors are well known in the art, one branch of which and would have a complemental female luer coupling. Thus, for a patient's entire stay at a hospital, the only needle associated with that one patient, ideally, would be the one which initially had been placed in the patient's vein to support the infusion catheter. In this way, the opportunity for inadvertent needle sticks would be reduced to a minimum.

OBJECTS OF THE INVENTION

Accordingly, it is an object of the present invention to provide a method and apparatus for transferring sterile fluid from an ampule to a hypodermic syringe after mixing liquid and solids in the ampule without the need of a hypodermic needle.

It is a further object of the present invention to provide a device and method as characterized above which reduces the amount of time which hospital staff must spend in transferring fluid from a sterile ampule to a hypodermic syringe while also eliminating the fear of an inadvertent needle stick thereby avoiding the possibility of both unwanted contamination and unwanted medication.

A further object of the present invention contemplates providing a device and method as characterized above which is extremely inexpensive to fabricate, safe to use and lends itself to mass production techniques.

A further object of the present invention is to provide a device which can reduce the number of times that needles are required in a hospital or other medical setting.

A further object of the present invention contemplates providing a device and method which minimizes the disposal problems of hypodermic syringes with needles.

A further object of the present invention contemplates providing a device and method for use in which a tell tale is associated with first the ampule that stores the medicine, and then the syringe so that the fluid transferred from the ampule and into the syringe will be known at all times. In this way, the chain of custody of the fluid can be more readily monitored.

A further object of the present invention contemplates providing a system for loading syringes that obviates the need for the medicating health professional from having to trundle a miniature pharmacy on a cart from patient to patient. By pre-filling the syringes at a remote location added security and efficiency may be provided.

When viewed from a first vantage point it is an object to provide a needleless dosage transfer system for removing a sterile fluid from a sealed vial to a conventional syringe. The syringe has a plunger such that the plunger of the syringe translates from a first position telescoped within an interior cylindrical hollow of the syringe to a second position where the plunger has been displaced from the interior hollow and replaced by the fluid. The vial is defined by an end, collapsible side walls extending from the end thereby defining a blind bore and having an open end, a coupler at the open end of the vial, and a removable cap occluding the open end at the coupler. The vial coupler is provided with means to connect to a needleless opening of the syringe to be in fluid communication therewith, whereby fluid can be transferred to the syringe from the vial without an interconnecting needle. The syringe then docks with an ampule having the lyophilized material for mixing and subsequent use.

Viewed from a second vantage point, it is an object to provide a method for transferring injectable fluids from a storage vial to a needleless syringe or other device using a male luer fitting. The syringe has a first coupling and an opening which communicates within an interior cylindrical hollow of the syringe so that fluid passes by the first coupling through the opening and into the hollow to load the syringe. The steps include providing a vial filled with fluid and with an outlet which has a second coupler defining the outlet. The vial is sealed by occluding the coupler outlet with a cap. Subsequently, removing the cap and orienting the first and second couplers into complemental fluid tight docking arrangement (so that the opening of the vial registers with the opening of the syringe) allows transfer of the contents of the vial to the syringe without the need for a traditional needle extraction system. An ampule then docks with the syringe for mixing a lyophilized substance with the syringe fluid.

Viewed from a third vantage point, it is an object to provide a method for forming an ampule to transfer medicine to be infused to a patient. The steps include forming an ampule with resilient walls so that the ampule can be collapsed, forming an opening on the ampule such that the opening is circumscribed by a coupler which is fashioned to receive a dose administering device, loading the ampule with the dry medicine and finally capping the ampule opening.

Viewed from a fourth vantage point, it is an object to provide for a process that dissolves a powdery substance stored an ampule. The ampule has a coupler defining the outlet and which has been sealed by occluding the coupler outlet with a cap. A needleless syringe or cannula is configured with a coupler and an opening which communicates within an interior cylindrical hollow of the syringe so that fluid passes by the coupler through the opening and into the cylindrical hollow and fills the syringe or cannula. The steps include providing a vial which has been filled with a fluid. The vial has a vial outlet including a coupler defining the vial outlet and which has been sealed by occluding the coupler of the vial outlet with a cap. Subsequently, removing the cap from the vial and orienting the couplers of the syringe or cannula and vial, respectively into complemental, fluid-tight locking engagement so that the opening of the vial registers with the opening of the syringe or cannula. Next, transfer the contents of the vial to the syringe or cannula. Subsequently, remove the cap from the ampule and orient the coupler of the ampule with the coupler of the syringe or cannula into complemental, fluid-tight locking engagement so that the opening of the ampule registers with the opening of the syringe or cannula. Next, transfer the fluid of the syringe into the ampule; mix the dry substance in the ampule with the fluid from the syringe until the dry substance is dissolved thus making a mixture preferably while the ampule and syringe or cannula remain mated. Then convey the mixture back into the syringe or cannula and prepare the syringe or cannula for the capability of inserting the mixture into an animate or inanimate object. The mixture may be filtered prior to insertion.

Viewed from a fifth vantage point, it is an object to provide for another process for forming an ampule to transfer pharmaceutical grade fluid or solid to be administered. The process including: forming an ampule with resilient walls so that the ampule can be collapsed and creating an orifice to pass the pharmaceutical grade fluid or solid into the ampule and then sealing the orifice; also forming an opening on the ampule and sealing with a cap and a scoreline such that the opening defines a coupler which is to be complementally fastened to and receives a dose administering device.

Viewed from a sixth vantage point, it is an object to provide for an ampule for storing a pharmaceutical product in a manner to inhibit lability of the product and permitting the transfer of the product in an aseptic manner to avoid nosocomial infection from ambient air. The ampule has resilient walls that can be collapsed and includes an orifice to pass a pharmaceutical grade fluid or solid therethrough and an opening on said ampule whereby the opening defines a coupler which is to be complementally fastened to receive a dose administering device.

Viewed from a seventh vantage point, it is an object to provide a filter cartridge having a body having first and second coupling-ends and a filter disposed therebetween; whereby the first coupling-end includes a female luer-type tapering for frictional engagement with a needleless syringe or cannula; and whereby the second coupling-end includes a male luer-type tapering for frictional engagement with a female luer-type taper such as on a needle or cannula. Further, this filter cartridge of instant invention can be integral with the ampule of the present invention.

Viewed from an eighth vantage point, it is an object of provide a filtered needle for use with the system of the present invention.

These and other objects were made manifest when considering the following detailed specification when taken into conjunction with the appended drawing figures.

DESCRIPTION OF PREFERRED EMBODIMENTS

Figure 1:
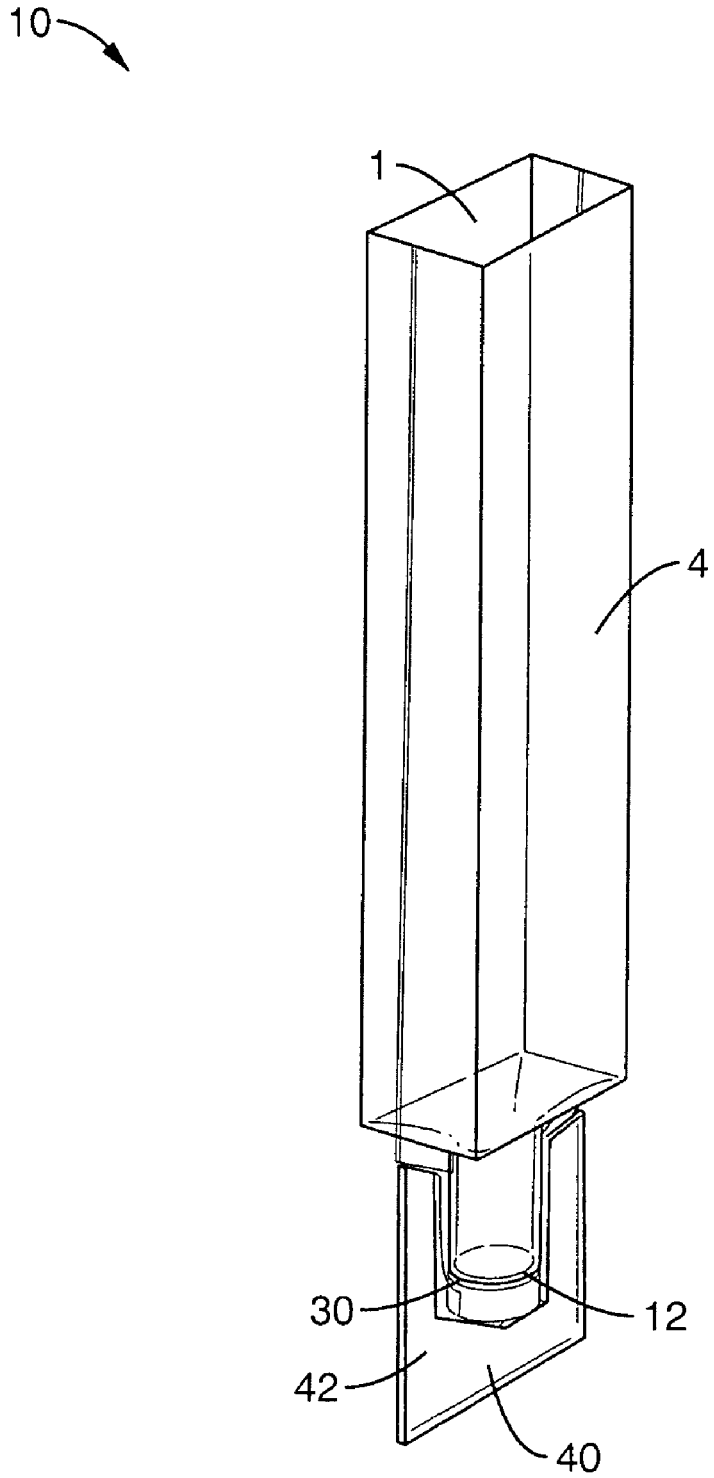
FIG. 1 is a perspective view of the ampule according to the present invention showing an open orifice and ready for accepting medication.

Considering the drawings, wherein like reference numerals denote like parts throughout the various drawing figures, reference numeral 10 is directed to the ampule according to the present invention.

Figure 4:
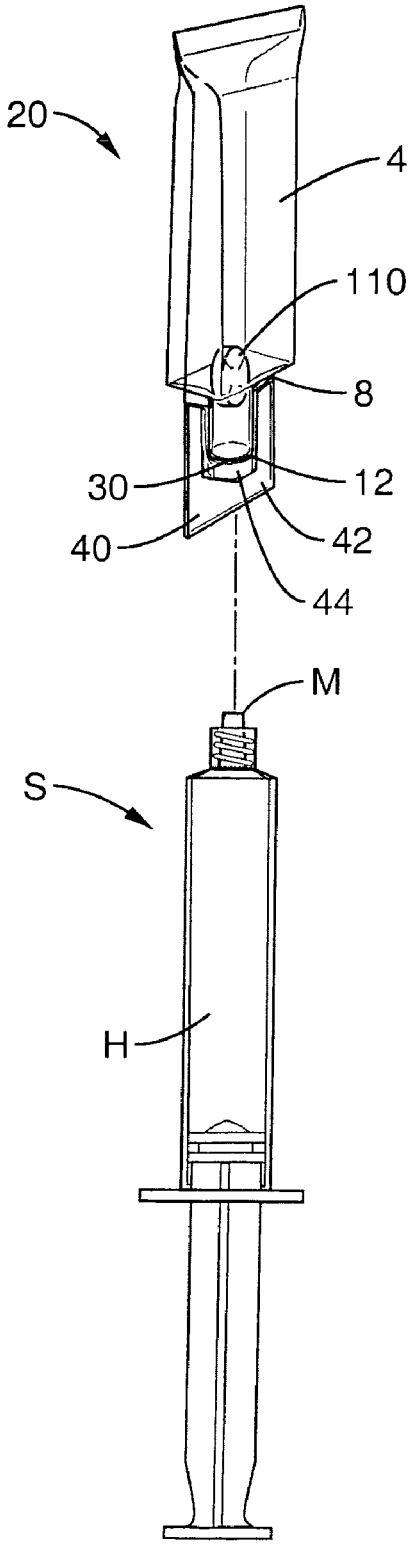
FIG. 4 shows an ampule's contents about to be transferred to the syringe which now has its associated plunger in an extended, deployed configuration and ready to transfer the fluid received from the FIG. 3 vial into the FIG. 4 ampule containing the powder or tablet contents.
Figure 5:
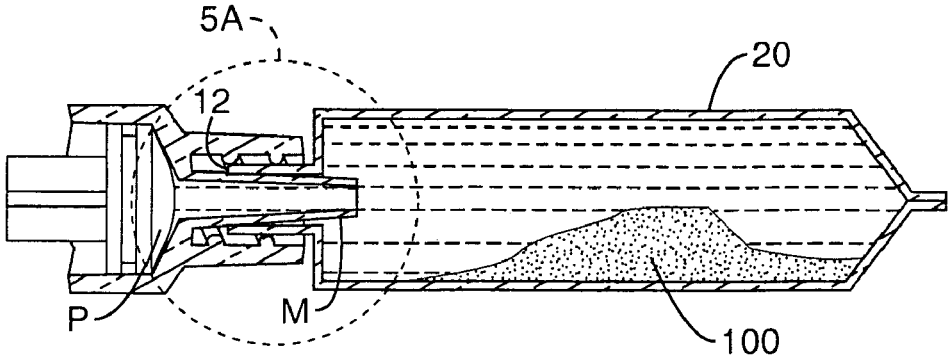
FIG. 5 shows a sectional view of a leading portion of the syringe of FIG. 4 engaged with the ampule after having dispensed the fluid into the ampule so as to dissolve the powder or tablet contents therein.

In its essence, and viewing FIG. 4, the ampule 10 is formed from two parts: a body portion 20 and a cap portion 40. An area of transition noted as a scoreline 30 serves as an area of demarcation between the cap 40 and body 20. The scoreline 30 allows the cap 40 to be dissociated from the body 20 so that the body 20 can dock with a syringe S as shown in FIG. 5 for filling the body 20 with the solution necessary to dissolve the powder 100 within the ampule 10 and subsequently refilling the syringe S with fluid F containing the now dissolved powder 100 ready for injection. An opening 12 at the scoreline tightly fits over the syringe's luer.

Figure 2A:
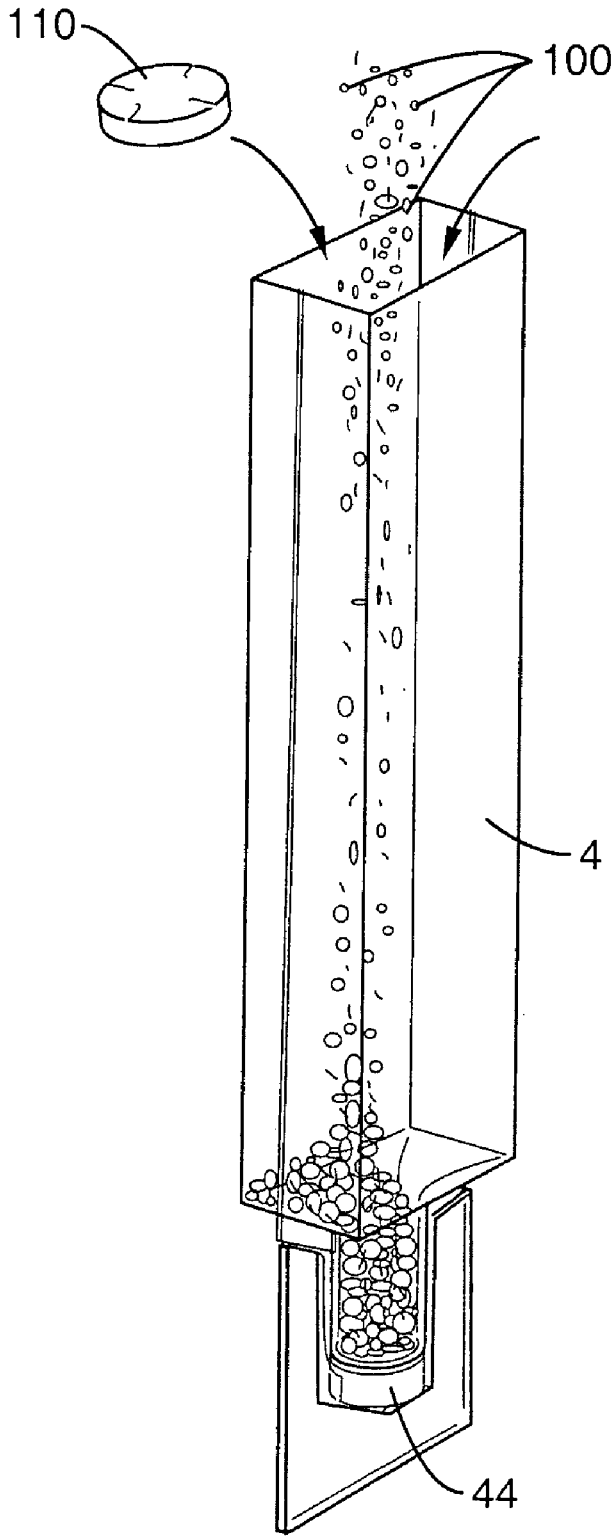
FIG. 2A is a perspective view of the ampule of FIG. 1 having free flow powder or a compressed tablet of medication inserted therein.
Figure 2B:
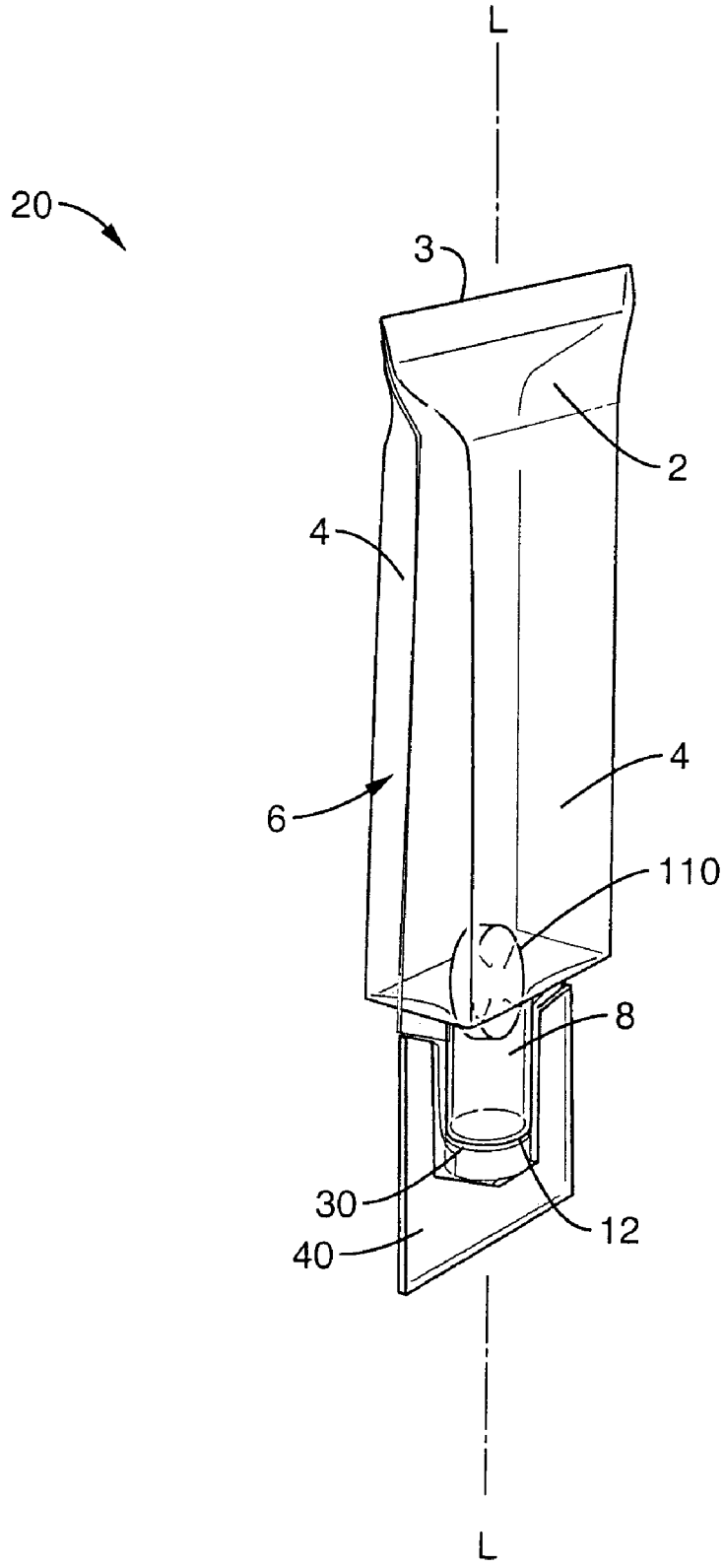
FIG. 2B shows the ampule of FIG. 2A with the orifice closed.

More specifically, and referring to the drawings in detail, the ampule 10 includes a body 20 having an orifice 1 (FIG. 1) for permitting the placement of free flow powder 100 or alternatively a compressed tablet 110 (FIG. 2A). Upon placement of powder 100 or tablet 110 the orifice 1 is hermetically and aseptically sealed forming an end wall 2 that appears as a fan-shaped seam 3. Peripheral side walls 4 have one proximal end coterminous with an outer periphery of the end wall 2 and extends away from the end wall 2 so that a blind bore 6 has been formed within which the powder 100 or tablet 110 is to be stored. As shown, the side walls 4 can be a substantially rectangular prism in shape, see FIG. 2B.

Figure 5A:
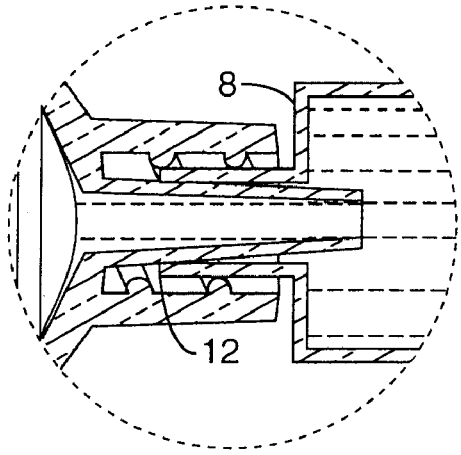
FIG. 5A details the converging opening of the ampule body.

Typically, dry powders and tablets such as a pharmaceutical drug or other medicaments can be stored within the blind bore 6. A distal end of the side wall 4 remote from the end wall 2 is provided with a slight tapering section 8 which converges towards a longitudinal axis L of the ampule 10 defining a converging end of the ampule 10. This tapering section 8 converges to an opening 12 (FIG. 5A), or outlet and thereafter communicates with the cap 40. The opening 12 defines a coupler of the ampule 10. The area of transition where the opening 12 is located is preferably coincident with the scoreline 30 to facilitate fracture of the ampule 10 precisely at the opening 12. Thus, the cap 40 can be separated from the body 20.

The cap 40 includes a flag type tab 42 on an exterior surface thereof upon which is printed the product contained within the ampule 10. The tab 42 is shown having a substantially rectangular, planar configuration to provide an exposed surface sufficient to place the name of the product on the tab. The tab 42 also serves as a purchase area to allow a person to grasp the cap 40 so that a twisting motion of the cap 40 with respect to the body 20 will cause severing of the body 20 from the cap 40 at the scoreline 30.

Figure 5B:
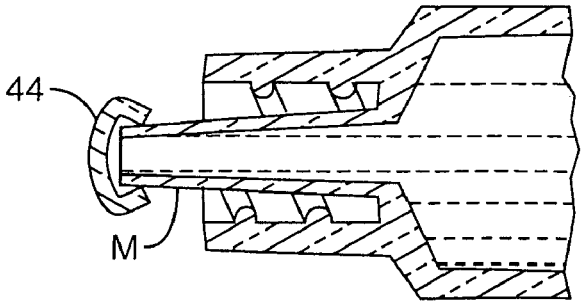
FIG. 5B details the diverging opening of the ampule cap.

The cap 40 also includes an interior passageway 44 having a diverging contour (FIG. 5B) which substantially mirrors the slope of the tapered section 8 of the body 20 of the ampule 10 about an axis of symmetry coincident with the scoreline 30. This diverging passageway 44 extends a short distance within the cap 40 for purposes to be assigned.

Figure 3:
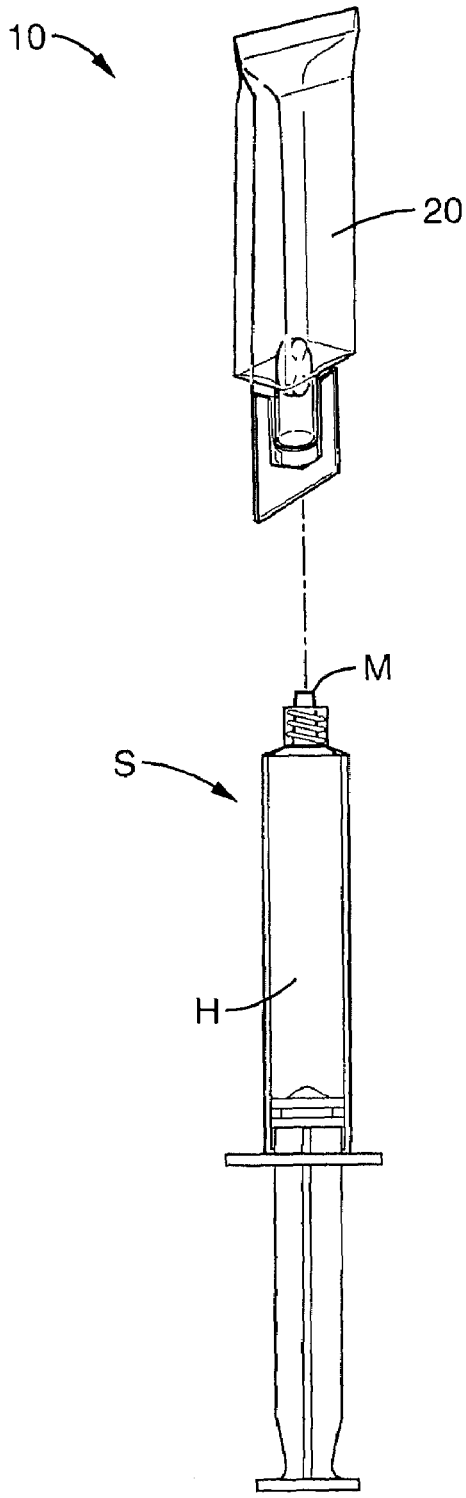
FIG. 3 shows a vial described in U.S. Pat. No. 5,716,346 and the syringe in predocking orientation where a coupler associated with the vial will be in frictional engagement with a coupler associated with the syringe. A plunger of the syringe is nested within the syringe's body.
Figure 3A:
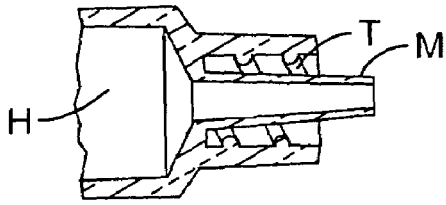
FIG. 3A details the syringe luer.

As shown in FIG. 4, prior to docking with the syringe S (or needleless cannula), the cap 40 will have been removed from the body 20 of the ampule 10. This allows the opening 12 of the body 20 to be exposed. The opening 12 has an inner peripheral dimension complemental to an exterior diameter of a male luer coupling M found on the syringe's or cannula's outlet. This coupling M defines an opening which forms a coupler of the syringe. Typically, this luer-type connection tapers and diverges as it approaches a cylindrical hollow H of the syringe S. (See FIG. 3A.) The luer may include a collar with an internal thread T.

Figure 7:
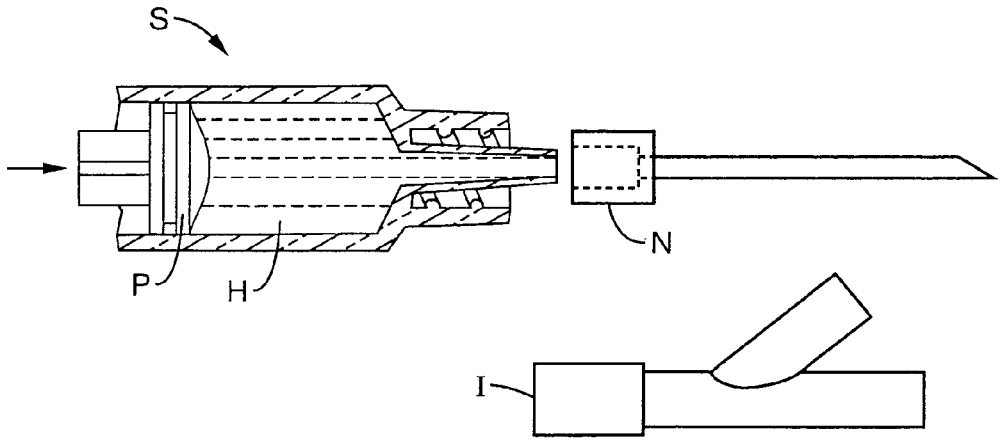
FIG. 7 shows the syringe ready for reception of a needle for injection into the patient or for insertion into the female luer inlet of a catheter.

For a friction fit, and with respect to the syringe S shown in FIGS. 5 and 7, the taper of the luer M traditionally couples to a needle. Instead, the syringe docks with the ampule 10 as shown in FIG. 5 such that the "male" conical taper of luer coupling M of the syringe S passes within the female opening 12 of the body 20 and becomes frictionally engaged at the opening 12, extending into the tapering section 8 of the ampule's body 20. Note that the plunger P on the syringe S (FIG. 5) is in a contracted position such that the syringe's cylindrical hollow H, located on an interior portion of the syringe S has received the plunger P to its entire extent and the push rod of the plunger P is in a position immediately adjacent to the cylindrical barrel of the syringe S. In other words, the syringe S is empty and the ampule 10 is already filled with the syringe's liquid.

Figure 6:
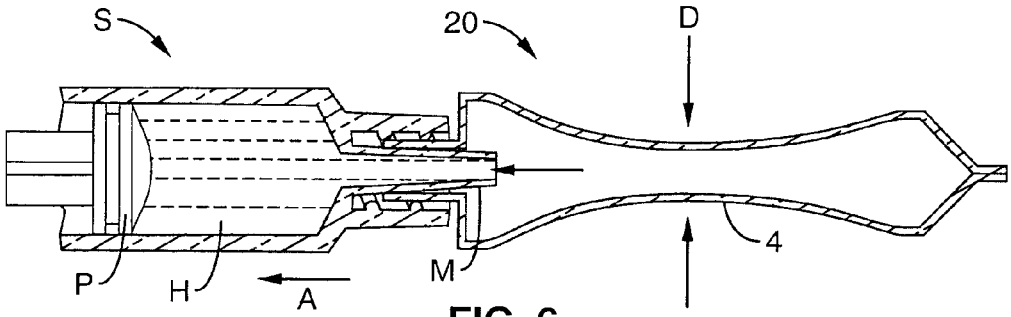
FIG. 6 shows a sectional view of the syringe just after drawing up the solution made from the fluid and dissolved powder or tablet and after the side walls of the ampule are collapsing. The ampule has been separated from the syringe after fluid extraction.

With respect to FIG. 6, it should be noted that the side walls 4 of the ampule 10 are formed from a material having the ability to elastically deform in the presence of force. In other words, the side walls 4 of the body of the ampule 10 can collapse. In this way, fluid F contained within the ampule 10 can be transferred back into the syringe S after mixing with the dry contents of the ampule. It is contemplated that one of three methods could be used to transfer the fluid F of the ampule 10 into the syringe S. Assume the syringe and ampule of FIG. 6 are coupled as in FIG. 5.

One scenario envisions the ampule 10 being deformed by providing external force in the direction of the arrows D along the outer periphery of the side walls 4. This causes the incompressible fluid F to be forced from the ampule 10 and into the syringe S. The plunger P will now be forced by fluidic pressure, induced from the ampule 10, to move the plunger P from a first contracted position to a second filled position. The cylindrical hollow H of the syringe S receives the fluid F. In other words, the syringe S will now have been filled with the fluid F and the plunger P will have been extended to a second position for delivery to a patient.

A second scenario, FIG. 6, involves docking the syringe S or needleless cannula with the ampule 10 as described above. Rather than exerting force D on the ampule 10, instead the plunger P is pulled in the direction of the arrow A which causes negative pressure to exist in the cylindrical hollow H of the syringe S. Since the side walls 4 of the ampule 10 are elastically deformable, the pressure induced by pulling the plunger P in the direction of the arrow A will cause the fluid F within the ampule 10 to migrate into the cylindrical hollow H of the syringe S, filling the syringe S and collapsing the walls 4.

A third scenario involves a hybridization of the first two mentioned techniques. Namely, force D on the exterior side walls 4 of the ampule 10 will be coupled in concert with pulling of the plunger P in the direction of the arrow A so that the incompressible fluid F will have migrated from the ampule 10 to the syringe S.

FIG. 7 is directed to a final manipulation of the components according to the present invention. The syringe S is placed in axial registry with the long axis needle N for injection into the patient. In this way, after the syringe S is loaded and ready for subsequent use, the contents of the fluid F within the syringe S will be ready for dispensing the medication to the patient. Different fluids can be pre-loaded into several syringes in a secure area. The healthcare professional can merely take a collection of the syringes or needleless cannulas to the site for ultimate medicating without having to use a drug preparation cart as is commonly in vogue today. The second variation suggests docking with a catheter inlet I.

Figure 8:
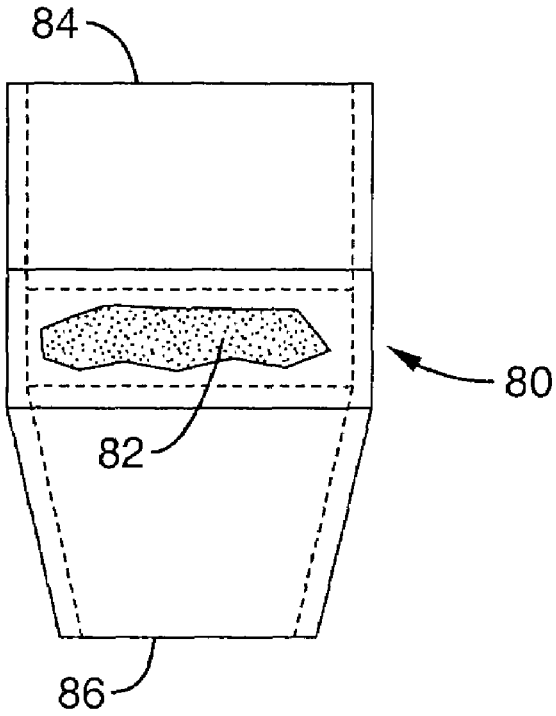
FIG. 8 shows a filter cartridge (with partial fragmentation) of the present invention.

FIG. 8 shows a filter cartridge 80 that is part of the present invention. The filter cartridge 80 has a filter 82 interiorly located (shown through a fragmentation of the wall of cartridge 80) to remove non-dissolved matter prior to the transfer of the solution to an end user. The cartridge 80 has a female luer-type tapered opening 84 at one extremity adapted to receive a complimentary male luer-type coupling either from a needleless syringe or cannula. In a spaced relationship at a remote extremity to opening 84, is a male luer-type tapered opening 86 adapted to be received a complimentary female luer-type coupling either from a needle or cannula or the like. Furthermore, the filter cartridge 80 could be integral with the ampule 10. The filter cartridge 80 is to be utilized preferably within the present invention after a liquid has been mixed with dry material to remove particulates.

Figure 9:
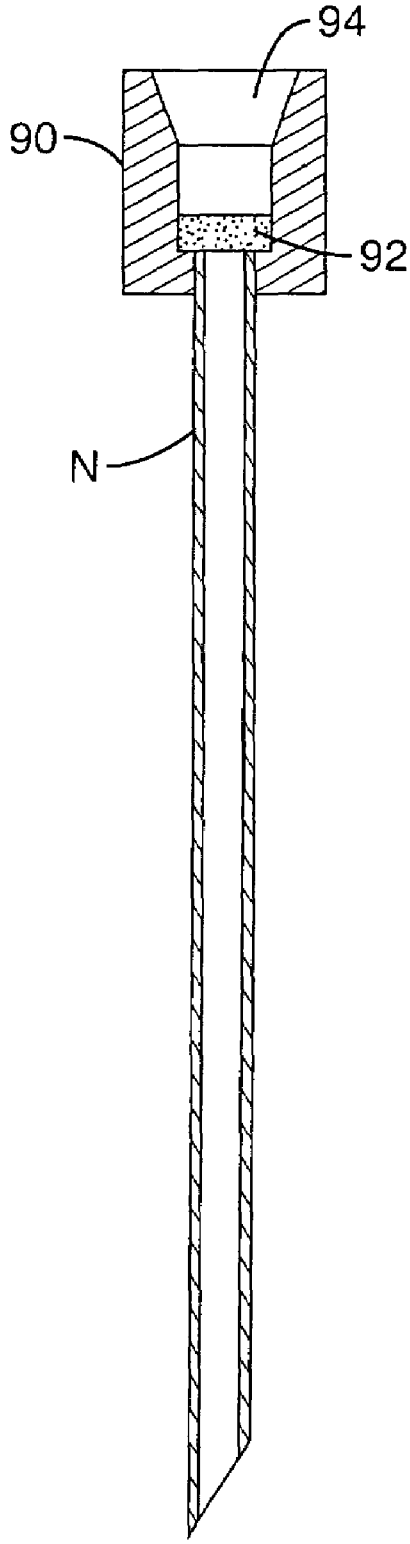
FIG. 9 shows a filtered needle for use with the present invention.

FIG. 9 shows a filtering needle 90 that can be used within the system of the present invention. The filtering needle 90 contains a filter 92 to filter out particulate matter prior to it passing through the hypodermic needle N shown in FIG. 9. There is also shown a female luer-type tapered opening 94 for complimentary reception of a male luer-type coupling from the syringe.

As had been mentioned briefly hereinabove, many people residing in hospitals as in-patients have infusion catheters operatively coupled at all times during their stay. Many of the infusion catheters include a female luer coupling (FIG. 7) compatible to the contour of syringe S. When this is the case, the syringe S never needs to include a needle on the male luer coupling M. Instead, one can administer the medicine directly into the infusion catheter via the catheter inlet I. In this way, the number of instances where trained medical personnel are exposed to administering fluids with hypodermic needles will be minimal. This reduces the amount of time and care required in the efficient performance of their tasks and minimizes both occasions for needle sticks and problems of needle disposal. In use and operation, the syringe S of FIG. 3 docks with the vial described in U.S. Pat. No. 5,716,346 to fill the syringe with liquid. Next the ampule 10 of FIG. 4 is opened by removing cap 40. Syringe S docks with ampule 10 (FIG. 5). The contents of the syringe enter the ampule. The contents are mixed (preferably with the syringe still attached), dissolving the dry matter of the ampule with the liquid from the syringe. The syringe, still docked to the ampule is then loaded with the liquid mixture. Optionally, the filter 80 may be initially interposed between the ampule 10 and syringe S or subsequently between the syringe and a conventional needle or catheter inlet I. When drawing the liquid through the filter, undissolved matter is entrained in the filter 82. The syringe is then ready for use.

A method and an apparatus for the storage and transfer of a lyophilisate is disclosed. An ampule prior to its sealment has an orifice at one end for the addition of the lyophilisate. The ampule has a body portion formed with flexibly deformable walls and defines a blind bore. After placement of the lyophilisate, the orifice is closed. An opening of the ampule is also included and has a tapered section adapted to frictionally fit over a taper of a male luer-type fitting commonly found on syringes and needleless cannulas. The opening is protected by a frangible cap integrally formed during manufacture. By removing the cap and docking the opening with a syringe, liquid enters the ampule for mixing with the dry contents in the ampule. After mixing the solution is removed by deforming the walls of the ampule. Fluid is forced from the ampule opening into a syringe. The opening of the ampule is protected with the cap that includes a scoreline which, when fractured, defines the opening. The cap to be removed from the ampule prior to its use is fabricated as one piece with the ampule preferably using a blow, fill, seal or injection molding technique in order to assure sterile conditions during manufacture and filling. A tab is associated with the cap which lists the ingredients within the ampule. The ampule also supports an area which lists the ampule's contents. The cap is specifically structured with a coupling so that after its removal from the ampule, it can frictionally engage the luer opening of the syringe or cannula. The tab provides indicia thereon as to the contents within the thus loaded syringe and to temporarily seal the syringe or cannula. The disclosed needleless dosage transfer system for filling medicating devices such as syringes or needleless cannulas minimizes the likelihood of an unwanted needle stick and to avoid the initial cost of a needle as well as the disposal cost of the needle.

Moreover, having thus described the invention, it should be apparent that numerous structural modifications and adaptations may be resorted to without departing from the scope and fair meaning of the instant invention as set forth hereinabove and as defined hereinbelow by the claims.

I claim:

1. A needleless dosage transfer system, for removing a sterile pharmaceutical grade nonliquid from a sealed ampule to a needleless syringe or needleless cannula, comprising in combination, an ampule defined by an end and collapsible side walls extending from said end thereby defining a blind bore and an open end, said side walls formed from resilient, collapsible material, a coupler at said open end of said vial, and a removable cap occluding said open end, said coupler configured and provided with means to connect to an opening of the syringe or cannula in fluid communication therewith, whereby the nonliquid can be transferred from the ampule without an interconnecting needle after removing said cap, liquifying the nonliquid and coupling said opening to the needleless syringe or cannula; and a filtered needle.

2. The system of claim 1 wherein said coupler at said open end of said ampule includes a converging portion as it extends from said ampule to said coupler open end.

3. The system of claim 1 wherein said opened end is integrally formed with said cap and is dissociated from said removable cap by means of a scoreline formed on said ampule associated at said opening.

4. The system of claim 3 wherein said removable cap includes an interior passageway having a diverging passageway substantially symmetrical to the said converging portion of said ampule adjacent said opening so that an axis of symmetry is provided at said scoreline with respect to said converging and diverging portions.

5. The system of claim 1 wherein said cap includes indicia means on an exterior surface thereof correlative with the fluid within said ampule.

6. The system of claim 4 wherein said passageway of said removable cap is dimensioned to frictionally override an opening of said needleless syringe or cannula which had been used to receive the fluid from the ampule whereby indicia on said removable cap travels with the needless syringe or cannula correlative of the fluid within said syringe which heretofore had been in said ampule.

7. The system of claim 1 wherein said cap includes a foot with facets at a perimeter thereof which provides a sterile support and prevents rolling of said cap and any devices connected thereto when placed horizontally on a flat surface.

8. An ampule for storing a nonliquid pharmaceutical product in a manner to inhibit lability of the product and permitting the transfer of the product in an aseptic manner to avoid nosocomial infection from ambient air comprising:

resilient walls that can be collapsed and creating an orifice to pass a pharmaceutical grade nonliquid fluid or solid therethrough;

an opening on said ampule whereby the opening is circumscribed by a coupler which is to be complementally fastened to receive a dose administering device;

whereupon after passing a pharmaceutical grade fluid or solid through said orifice, sealing the orifice to form an end wall whereby said side walls extend from said end wall to define a blind bore and making said side walls so that said side walls can be distorted to force said fluid or solid within the ampule out said opening once said cap has been severed.

9. The ampule of claim 8 further including a cap for occluding said opening.

10. The ampule of claim 9 further providing a scoreline proximate said opening whereby any contents within said ampule can be accessed by severing said cap for said ampule at said scoreline.

11. The ampule of claim 9 whereby said cap is formed with an interior passageway having a dimension complemental to an outlet of a syringe or cannula for frictional engagement thereover after having transferred a mixture from said ampule to a syringe or cannula.

12. The ampule of claim 8 wherein said cap has a tab surface.

13. The ampule of claim 12 wherein said tab surface includes indicia thereon correlative of a mixture within the ampule.

14. The ampule of claim 13 wherein said indicia provides an indicator of the contents within the ampule.

15. A needless dosage transfer system, comprising, in combination:

an ampoule having a lyophilized pharmaceutical aseptically located therewith; the pharmaceutical characterized as being nonliquid;

an integrally formed cap closing said ampoule, said cap located at a score line on said ampoule to facilitate removal, said score line on said ampoule, once exposed by removal of said cap, dimensioned to receive a luer coupling thereat, and walls of said ampoule formed of deformable flexible non-porous material.

* * * * *